US011572826B1

(12) United States Patent
Yuan

(10) Patent No.: US 11,572,826 B1
(45) Date of Patent: Feb. 7, 2023

(54) ENGINE AND IGNITION ASSEMBLY WITH TWO PISTONS

(71) Applicant: Defang Yuan, Ottawa (CA)

(72) Inventor: Defang Yuan, Ottawa (CA)

( * ) Notice: Subject to any disclaimer, the term of this patent is extended or adjusted under 35 U.S.C. 154(b) by 0 days.

(21) Appl. No.: 17/693,094

(22) Filed: Mar. 11, 2022

(51) Int. Cl.
*F02B 75/28* (2006.01)
*F02P 5/10* (2006.01)
*F02M 25/03* (2006.01)
*F02D 41/40* (2006.01)

(52) U.S. Cl.
CPC ..... *F02B 75/28* (2013.01); *F02D 41/401* (2013.01); *F02M 25/03* (2013.01); *F02P 5/103* (2013.01); *F02D 2200/024* (2013.01)

(58) Field of Classification Search
CPC .. F02B 75/28; F02D 41/401; F02D 2200/024; F02M 25/03; F02P 5/103
See application file for complete search history.

(56) References Cited

U.S. PATENT DOCUMENTS 1,301,658 A * 4/1919 Cutler ..... F02B 75/042 123/78 AA
4,169,435 A * 10/1979 Faulconer, Jr. ..... F02B 41/00 123/48 A
6,094,915 A * 8/2000 Negre ..... F01B 17/025 60/39.6
6,230,671 B1 * 5/2001 Achterberg ..... F02B 75/28 123/48 R
6,354,250 B1 * 3/2002 Rodriguez Lopez ..... F02B 75/041 123/48 R
11,131,255 B1 * 9/2021 Yuan ..... F02D 15/04
11,136,916 B1 * 10/2021 Zhao ..... F01B 7/02
2007/0089694 A1 * 4/2007 Hacsi ..... F02B 21/00 123/48 D
2008/0000445 A1 * 1/2008 Kim ..... F02M 25/0227 123/295
2014/0261297 A1 * 9/2014 Lippitt ..... F02B 75/02 123/27 R
2017/0241368 A1 * 8/2017 Anders ..... F02B 23/0669
2019/0186899 A1 * 6/2019 Wheitner ..... G01B 11/14
2020/0149493 A1 * 5/2020 Perr ..... F02F 1/10

* cited by examiner

*Primary Examiner* — Kurt Philip Liethen

(57) ABSTRACT

An ignition assembly configuration in piston engine with a main piston and an auxiliary piston, the ignition assembly is mounted on the cylinder wall and connects to the combustion chamber; the ignition assembly comprises an connection cut-out passage, an ignition device, or ignition device combined with a fuel injection nozzle, or an ignition device combined with a fuel injection nozzle and a pressure sensor passage. Wherein the auxiliary piston has a by-pass passage to keep the ignition assembly connected to the combustion chamber when the auxiliary piston moves down below the uppermost position of the main piston and blocks the ignition assembly cut-out passage; wherein the uppermost position of the ignition assembly is at or aligned with the uppermost position of the auxiliary piston in combustion stroke, the lowermost position of the ignition assembly is at or aligned with the uppermost position of the main piston. Fuel-water injection, multiple fuel injections and combustions can be easily practiced in the new configuration.

19 Claims, 5 Drawing Sheets

ENGINE AND IGNITION ASSEMBLY WITH TWO PISTONS

FIELD OF THE INVENTION

The present disclosure relates to piston engines or reciprocating engines with an extended minimum combustion volume, wherein an additional (auxiliary) piston is employed to constrain the combustion chamber volume trajectory. The novel piston engine has a widened nearly constant combustion volume clearance Vc (or minimum volume Vc) near its top dead center of the main piston, so that the peak combustions can be located at a bigger crank angle (>30° CA) to boost the output torque on crankshaft, and different configurations of ignition device, fuel injection device and cylinder pressure sensor are presented in the invention.

BACKGROUND OF THE INVENTION

In previously filed novel piston engine disclosures, (U.S. application Ser. Nos. 17/064,051, 17/094,300, 17/157,890 and 17/500,682, U.S. patent Ser. Nos. 11/136,916 and 11/131,255), different methods and engine geometries are presented. In the present disclosure, more considerations of ignition, fuel injection and fuel-water mixture are described in details.

In the new engines, because the fixed cylinder head in the conventional engine is replaced by the moving piston (the auxiliary piston), there is no space or room on the top side of the cylinder to install ignition plug, intake and exhaust valves. Therefore, there remains a need for a novel configuration for installing the ignition plug, cylinder pressure sensing, the intake and exhaust valves to make the new piston engine practical both in manufacturing and cost.

SUMMARY OF THE INVENTION

The present invention disclosures a piston engine and its ignition assembly, comprising:

a cylinder liner and a cylinder wall defining an interior space therein; the cylinder liner encloses a chamber therein, a main piston configured to fit sealingly inside the cylinder liner and move up and down along the centerline of the cylinder liner therewithin; an auxiliary piston is configured to fit inside the cylinder liner and move up and down along the centerline of the cylinder liner, wherein the main piston and the auxiliary piston move at different frequencies; the main piston and the auxiliary piston move at different stroke distances; the lowermost position of the auxiliary piston is below the uppermost position of the main piston, the space between the auxiliary piston and the main piston wherewithin the cylinder liner defines a combustion chamber; an ignition assembly is mounted sealingly on the cylinder wall, the ignition assembly connects to the combustion chamber via a cut-out passage on the cylinder liner, wherein the uppermost position of the cut-out passage is at or aligned with the uppermost position of the auxiliary piston lower face in combustion stroke, the lowermost position of the cut-out passage is at or aligned with the uppermost position of the main piston upper face; wherein the auxiliary piston has a by-pass passage, the by-pass passage connects the ignition assembly to the combustion chamber when the auxiliary piston moves down below the uppermost position of the main piston and blocks the cut-out passage, a pressure sensor passage within the ignition assembly is configured to make available to detect the combustion chamber pressure or cylinder pressure in combustion stroke in order to adjust the delay timing of ignition to keep the peak pressure of the combustion chamber in combustion stroke to be located at >30° CA to make higher fuel efficiency.

The present invention disclosures another piston engine and its ignition assembly with multiple fuel injections, comprising:

a cylinder liner and a cylinder wall defining an interior space therein, the cylinder liner encloses a chamber therein, a main piston configured to fit sealingly inside the cylinder liner and move up and down along the centerline of the cylinder liner therewithin; an auxiliary piston is configured to fit inside the cylinder liner and move up and down along the centerline of the cylinder liner, the lowermost position of the auxiliary piston is below the uppermost position of the main piston, the space between the auxiliary piston and the main piston wherewithin the cylinder liner defines a combustion chamber, wherein the main piston and the auxiliary piston move at different frequencies, the main piston and the auxiliary piston move at different stroke distances, the said frequencies and the stroke distances of the auxiliary piston and the main piston are coordinated to keep the combustion chamber volume nearly constant from crank angle 0° CA to 30° CA; fuel is injected multiple times between crank angle −30° CA and 30° CA, an ignition assembly is mounted sealingly on the cylinder wall, the ignition assembly connects to the combustion chamber via a cut-out passage on the cylinder liner, wherein the uppermost position of the cut-out passage is at or aligned with the uppermost position of the auxiliary piston lower face in combustion stroke, the lowermost position of the cut-out passage is at or aligned with the uppermost position of the main piston upper face, wherein the auxiliary piston has a by-pass passage, the by-pass passage connects the ignition assembly to the combustion chamber when the auxiliary piston moves down below the uppermost position of the main piston and blocks the cut-out passage, a pressure sensor passage within the ignition assembly is configured to make available to detect the combustion chamber pressure or cylinder pressure of each combustion in combustion stroke in order to adjust each fuel injection timing and/or each fuel ignition timing to keep each peak pressure of the combustion chamber to be located and scattered from 20° CA to >30° CA to reduce cylinder pressure stress.

The present invention disclosures another piston engine and its ignition assembly with fuel-water mixture, comprising:

a cylinder liner and a cylinder wall defining an interior space therein, the cylinder liner encloses a chamber therein, a main piston configured to fit sealingly inside the cylinder liner and move up and down along the centerline of the cylinder liner therewithin; an auxiliary piston is configured to fit inside the cylinder liner and move up and down along the centerline of the cylinder liner; the lowermost position of the auxiliary piston is below the uppermost position of the main piston; the space between the auxiliary piston and the main piston wherewithin the cylinder liner defines a combustion chamber;

wherein the main piston and the auxiliary piston move at different frequencies, the main piston and the auxiliary piston move at different stroke distances, the said frequencies and the stroke distances of the auxiliary piston and the main piston are coordinated to keep the combustion chamber volume nearly constant from crank angle 0° CA to 30° CA; water or fuel-water mixture is injected from crank angle 0° CA to 30° CA, an ignition assembly is mounted sealingly on the cylinder wall, the ignition assembly connects to the combustion chamber via a cut-out passage on the cylinder liner, wherein the uppermost position of the cut-out passage is at or aligned with the uppermost position of the auxiliary piston lower face in combustion stroke, the lowermost position of the cut-out passage is at or aligned with the uppermost position of the main piston upper face;

wherein the auxiliary piston has a by-pass passage, the by-pass passage connects the ignition assembly to the combustion chamber when the auxiliary piston moves down below the uppermost position of the main piston and blocks the cut-out passage, a pressure sensor passage is configured to make available to detect the combustion chamber pressure or cylinder pressure in combustion stroke in order to adjust the delay timing of ignition of the water or fuel-water mixture to keep the peak pressure of the combustion chamber in combustion stroke to be located at >30° CA to make higher fuel efficiency and reduce cylinder temperature stress.

Other features and advantages of the present invention will become apparent from the following detailed description and the accompanying drawings, which illustrate, by way of example, the principles of the invention.

BRIEF DESCRIPTION OF THE DRAWINGS

By way of example only, preferred embodiments of the present invention are described hereinafter with reference to the accompanying drawings, wherein.

DETAILED DESCRIPTION OF THE INVENTION

Figure 1:
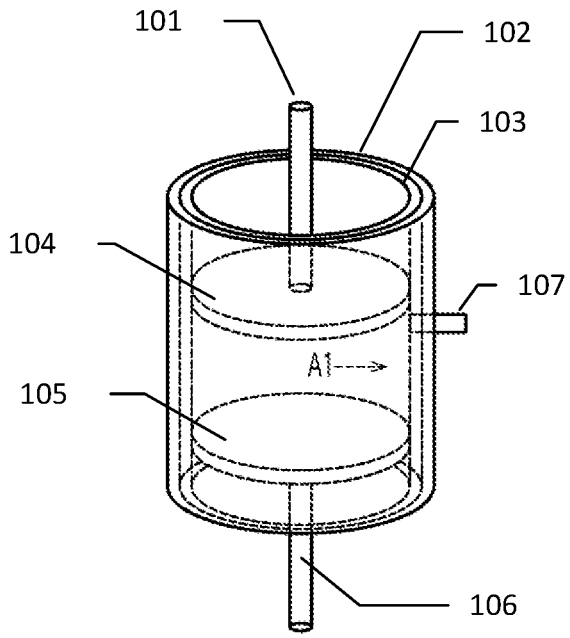
FIG. 1 is an illustration of the present invention engine with ignition assembly.

It is to be understood that the disclosure is not limited in its application to the details of the embodiments as set forth in the following description. The invention is capable of other embodiments and of being practiced or of being carried out in various ways.

Furthermore, it is to be understood that the terminology used herein is for the purpose of description and should not be regarded as limiting. Contrary to the use of the term "consisting", the use of the terms "including", "containing", "comprising", or "having" and variations thereof is meant to encompass the items listed thereafter and equivalents thereof as well as additional items. The use of the term "a" or "an" is meant to encompass "one or more". Any numerical range recited herein is intended to include all values from the lower value to the upper value of that range.

Graphics are used in order to simplify the description which involves curves and transcendental functions.

In the description, the said ignition assembly of the present invention is defined or configured as:

A, an ignition device, with or without a pressure sensor passage, or,

B, an ignition device with a fuel injection nozzle, or

C, an ignition device with a fuel injection nozzle and a pressure sensor passage, The directions and positions used in the description, such as upper, uppermost, lower, lowermost, up, down, vertically, horizontally, left and right, are based on the directions and relative positions shown in the Figures, and are not necessarily the directions and positions in actual real-life applications. The term position used in the description may refer to the physical position or the crank angle position. The abscissa (x-axis) of the variable in ° CA is identified by the crank angle of main crankshaft. Crank angle a=0° CA is defined as the angle when the center of the big end of the main connecting rod is at its uppermost position of the main crankshaft (or at the very top position of the main crankshaft).

In a conventional single-piston engine, the ignition device and fuel injection nozzle are generally installed on the top of the cylinder head. In the present invention, the ignition device and/or fuel injection nozzle are installed on the side(s) of the cylinder wall/cylinder liner because there is no fixed cylinder head to support the assembly; this configuration is very different in comparison to a conventional piston engine.

In a conventional opposed-piston engine, wherein the two pistons are always moving at same frequency and at same stroke distance, the ignition device and/or fuel injection nozzle can be installed at the vertically middle position between two pistons (or at the vertically middle position of the combustion chamber in between two pistons) on the side(s) of the cylinder liner and cylinder wall. When the two opposed pistons are moving at different frequencies or/and at the different stroke distances, the ignition device and/or fuel injection nozzle installation positions have to be re-configured because the said "vertically middle position" is no more a preferred position. Or in other expression, the combustion chamber trajectory is dramatically changed when the two opposed pistons are moving at different frequencies or/and at the different moving distances, the ignition assembly which works perfectly in a conventional opposed-piston engine does not work properly in the new engine. This invention is based on the previous patented piston engine configurations; please refer to U.S. Ser. No. 11/078,836, U.S. Ser. No. 11/136,916 and U.S. Ser. No. 11/131,255 for better understanding of the piston movements and combustion chamber geometries.

One of the embodiments of the present invention is shown in FIG. 1. Wherein 105 is a main piston, 105 is connected to a main connecting rod (or conrod) 106, the main connecting rod is connected to a main crankshaft; 104 is an auxiliary piston (aux. piston), 104 it connected to an auxiliary conrod 101; piston 105 and 104 are moving up and down along the vertical centerline of a cylinder liner at different frequencies and/or at different stroke distances; a combustion chamber is formed in between lower face of piston 104 and upper face of piston 105 within the cylinder liner; 102 is a cylinder wall (or sometimes named as a cylinder block), and 103 is the cylinder liner; 107 is a ignition assembly, 107 can be A): an ignition device with or without a pressure sensor passage, or B): an ignition device with a fuel injection nozzle, or C): an ignition device with a fuel injection nozzle and a pressure sensor passage. The intake port and exhaust port are not shown in the figure; please refer to U.S. Ser. No. 11/131,255 for better understanding.

Figure 2:
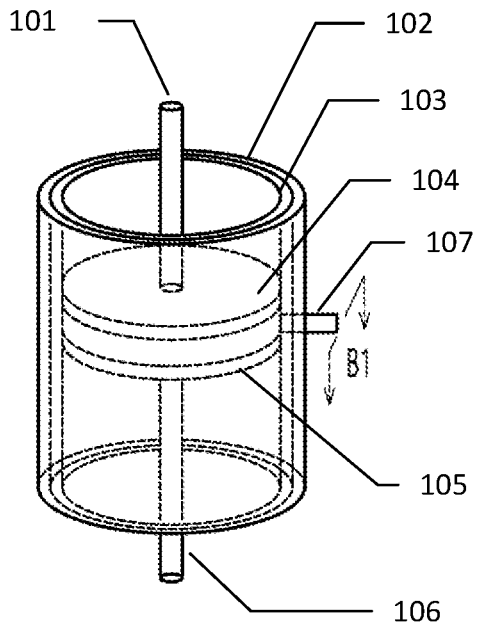
FIG. 2 is another illustration of the present invention engine with ignition assembly.

FIG. 2 is another embodiment of the present invention similar as in FIG. 1 but where the combustion chamber volume is at its minimum (Vc). Wherein 105 is a main piston, 105 is connected to a main connecting rod (or conrod) 106; 104 is an auxiliary piston (aux. piston), 104 it connected to an auxiliary conrod 101; piston 105 and 104 are moving up and down along the vertical centerline of a cylinder liner at different frequencies and/or at different stroke distances; a combustion chamber is formed in between lower face of piston 104 and upper face of piston 105 within the cylinder liner; 102 is a cylinder wall (or sometimes named as a cylinder block), and 103 is the cylinder liner; 107 is a ignition assembly, 107 can be A): an ignition device with or without a pressure sensor passage, or B): an ignition device with a fuel injection nozzle, or C): an ignition device with a fuel injection nozzle and a pressure sensor passage. The intake port and exhaust port are not shown in the figure; please refer to U.S. Ser. No. 11/131,255 for better understanding.

Figure 3A:
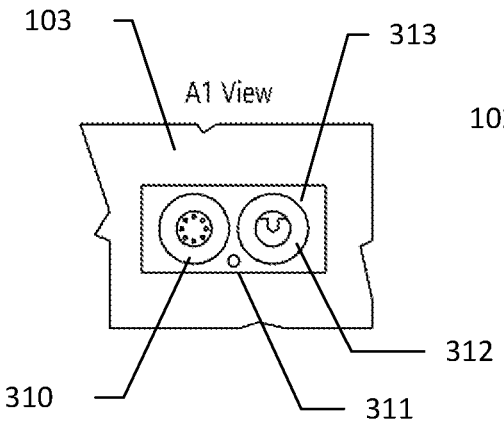
FIG. 3A is an illustration of A1 section view of an ignition assembly of the present invention.

The A1 section view of the ignition assembly of FIG. 1 is shown in FIG. 3A. Wherein 103 is the cylinder liner, 313 is a cut-out passage of the cylinder liner, 310 is a fuel injection nozzle, 312 is a ignition device (for example, a spark plug, a glow plug, or a laser igniter, etc.), 311 is a pressure sensor passage which connects a pressure sensor to the combustion chamber to ensure the combustion chamber pressure (or cylinder pressure) be detected accurately and timely by the pressure sensor. 311 is always connects with the cut-out passage 313. The pressure sensor itself is not shown in the figure.

Figure 3B:
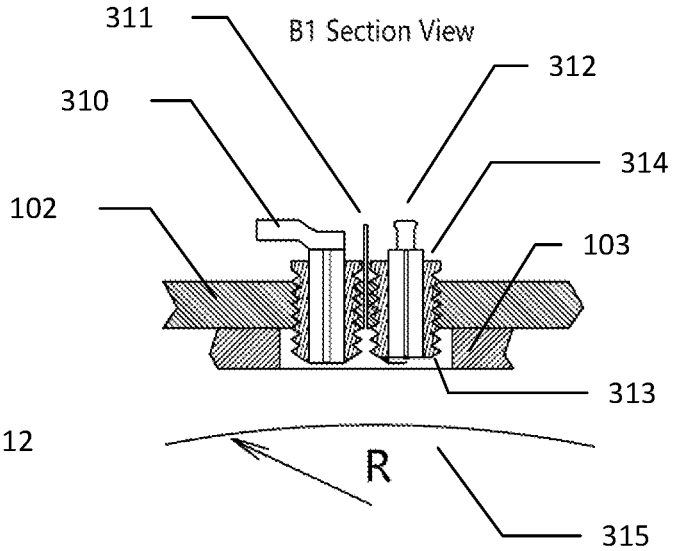
FIG. 3B is an illustration of B1 section view of an ignition assembly of the present invention.

The B1 section view of the ignition assembly of FIG. 2 is shown in FIG. 3B. Wherein 103 is the cylinder liner, 313 is the cut-out passage of the cylinder liner; 102 is the cylinder block or the cylinder wall; 310 is the fuel injection nozzle, 312 is the ignition device (for example, a spark plug, a glow plug, or a laser igniter, etc.), 311 is the pressure sensor passage which connects a pressure sensor to the combustion chamber to ensure the combustion chamber pressure (or cylinder pressure) be detected accurately and timely by the pressure sensor. The pressure sensor itself is not shown in the figure. Wherein 102 and 103 are simplified as flat panels in the figure for easy understanding; and in real applications 102 and 103 are concentric (circler) cylinders with their radiuses R(s) as shown as 315 in the figure. 314 is the sealing which keeps the spark plug and fuel injection nozzle sealed to the cylinder wall 102; the spark plug tip and/or the fuel injection nozzle tip are connected to the combustion chamber via the cut-out passage 313; the spark plug tip and/or the fuel injection nozzle tip are sealed from the outside environment of the cylinder wall; the pressure sensor passage 311 is connecting the combustion chamber to the pressure sensor and keeps sealed from the outside environment of cylinder wall 102.

Figure 3C:
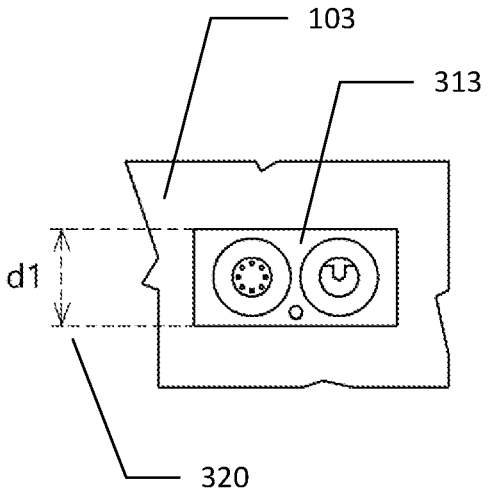
FIG. 3C is a cut-out passage configuration of A1 section view of the ignition assembly.

The A1 section view of the ignition assembly, the cut-out passage and dimension d1 is further shown in FIG. 3C. Wherein 103 is the cylinder liner, 313 is the cut-out passage of the cylinder liner. d1 (320) is the vertical dimension of the cut-out passage. The fuel nozzle, spark plug and pressure senor passage are placed within d1.

Figure 3D:
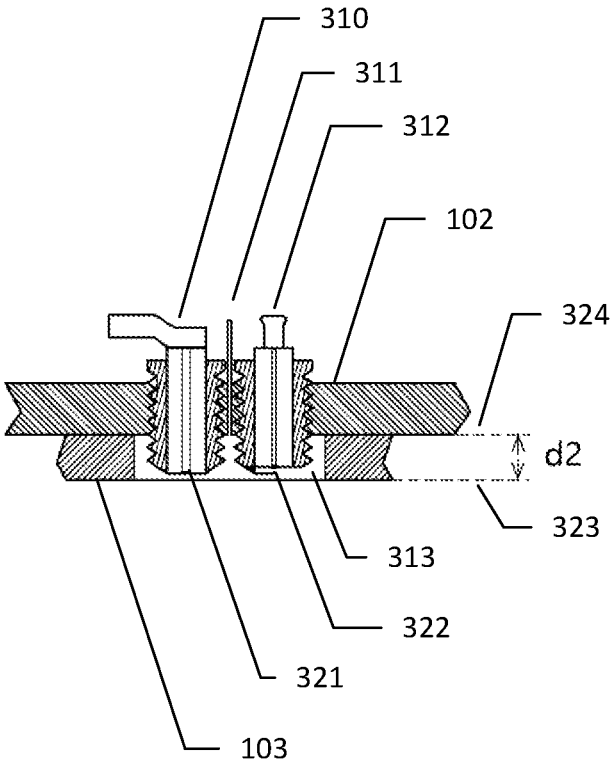
FIG. 3D is a cut-out passage configuration of B1 section view of the ignition assembly.

The B1 section view of the ignition assembly, the cut-out passage and dimension d2 in depth is shown in FIG. 3D. Wherein 103 is the cylinder liner, 313 is the cut-out passage of the cylinder liner; 102 is the cylinder block or the cylinder wall; 321 is the tip of the fuel injection nozzle 310, 322 is the tip of the ignition device 312 (for example, a spark plug, a glow plug, or a laser igniter, etc.), 311 is the pressure sensor passage which connects a pressure sensor to the combustion chamber to ensure the combustion chamber pressure (or cylinder pressure) be detected accurately by the pressure sensor. The pressure sensor itself is not shown in the figure. Wherein 102 and 103 are simplified as flat panels in the figure for easy understanding; and in real applications 102 and 103 are concentric cylinders with their radiuses R(s) as shown as 315 in the FIG. 3B. Tip 321 and tip 322 are also referred to as the tip the ignition assembly. The connection between the ignition assembly and the combustion chamber in the following description is actually referred to as the connection between the tip of the ignition assembly and the combustion chamber, the said connection is fulfilled by the cut-out passage 313.

The values of d1 and/or d2 are very important in the invention: 1), d1 must be big enough to keep the ignition assembly connecting sufficiently to the combustion chamber in combustion stroke, and d1 must be small enough to prevent leakage between cylinder liner and pistons. 2), d2 is smaller or equal to the thickness of the cylinder liner 103; for example, 324 is the out surface of the cylinder liner, and 323 is the inner surface of the cylinder liner, tip 321 of fuel injection nozzle 310 and tip 322 of ignition device 312 must be contained within the thickness d2 of the cylinder liner or cut-out passage 313; or in other words, the tip 321 and tip 322 must be protruded from surface 324 to make the tips as close as possible to the combustion chamber, and the tip 321 and tip 322 must be recessed from surface 323 to make sure the tips not touching with pistons and piston rings (piston rings are not shown in the figure) in any operation conditions. The tip 321 or/and tip 322 is expressed as the tip of ignition assembly in following descriptions.

In FIG. 3B and FIG. 3D, the cylinder liner 103 and cylinder block 102 (or cylinder wall) are generally in tighten mechanical connection; and sometimes the cylinder liner 103 and cylinder block 102 (or cylinder wall) can be combined into a single part to simplify the manufacturing.

Figure 4:
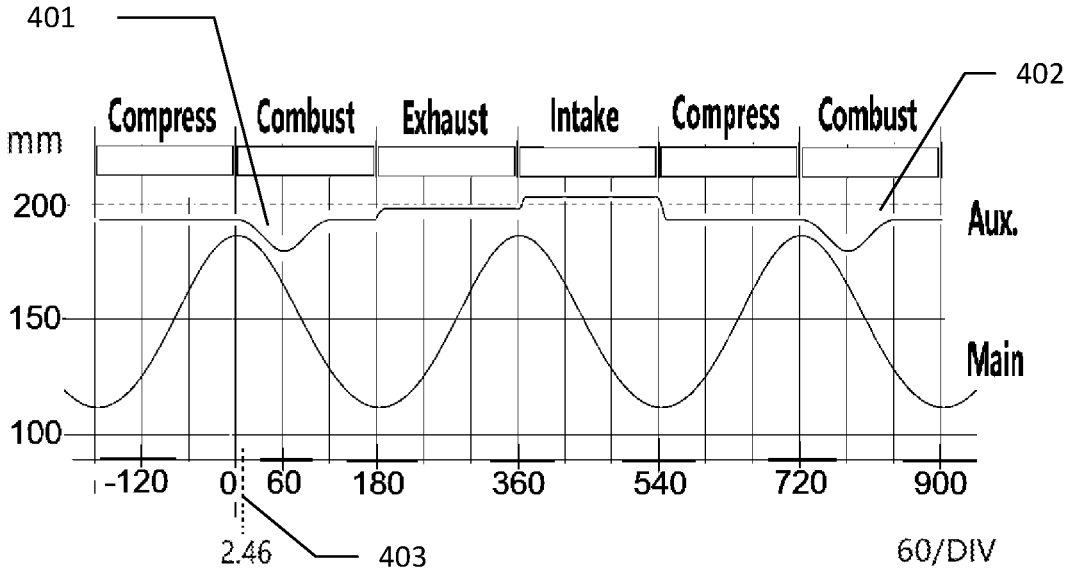
FIG. 4 is an illustration of piston positions and combustion chamber volume of one of the embodiments of the present invention with 4-stroke configuration.

FIG. 4 shows the positions of the two pistons and the relations between combustion chamber and ignition assembly. The main piston position is mark as 'Main'; the top dead center TDC 403 of the main piston is located at 0° CA when crankpin offset is zero, the top dead center 403 of the main piston is located at 2.46° CA when crankpin offset is 8 mm as in Toyota NR; the auxiliary piston position is marked as "Aux." In most of strokes (compression, combustion, intake and exhaust), the ignition assembly must be configured to be in connection with the combustion chamber, or the physical space between the tip of the ignition assembly and the combustion chamber is free to conduct pressure and free to conduct fuel/air/combusting gases and mixtures. At the lowest position of the aux. piston, the cut-out passage and/or the right end of the by-pass passage are closed to the combustion chamber by the aux. piston.

The most important or critical configuration of the ignition assembly is in combustion stroke 401 (and 402) wherein the aux. piston is at a lower position, because the combustion chamber pressure is very high, the combustion chamber must be securely sealed from outside environment and sufficiently connected to the ignition assembly at same time. The said combustion stroke is generally located from 0° CA to 160° CA in a 4-stroke configuration. And it is apparent that the bigger the d1, the better the connection between (the tip of) the ignition assembly and the combustion chamber, the more difficult to seal the combustion chamber from the outside environment. Or the smaller the d1, the lesser sufficient the connection between (the tip of) the ignition assembly and the combustion chamber, the easier to seal the combustion chamber from the outside environment. The choice of d1 is actually a compromising between a better sealing of the combustion chamber from the outside and a sufficient connection of the ignition assembly to the combustion chamber. Here the connection means "a physical passage (or passages) which provides sufficient conductivity between (the tip of) the ignition assembly and the combustion chamber by means of air, fuel, mixture gases or combustion gases". At certain given cylinder liner inner diameter, the smaller the combustion chamber volume, the smaller the value of d1.

In other words, the ignition assembly must be designed to make sufficient connections between the combustion chamber and the ignition assembly, so that ignition spark and fuel injection can be reached into the combustion chamber sufficiently. And at near 0° CA to near 46° CA, the combustion chamber pressure must be detected accurately and without less delay. 46° CA is the position where most peak pressure to be located when the aux. piston is moving at three times of the frequency of the main piston.

In combustion stroke, the ignition assembly must not be compromising the sealings or the air-tightens of the combustion chamber, any leakage from combustion chamber to outside environment will cause losses in energy efficiency in combustion.

Some examples of the designs and configurations of the ignition assembly are descried thereafter.

Figure 5:
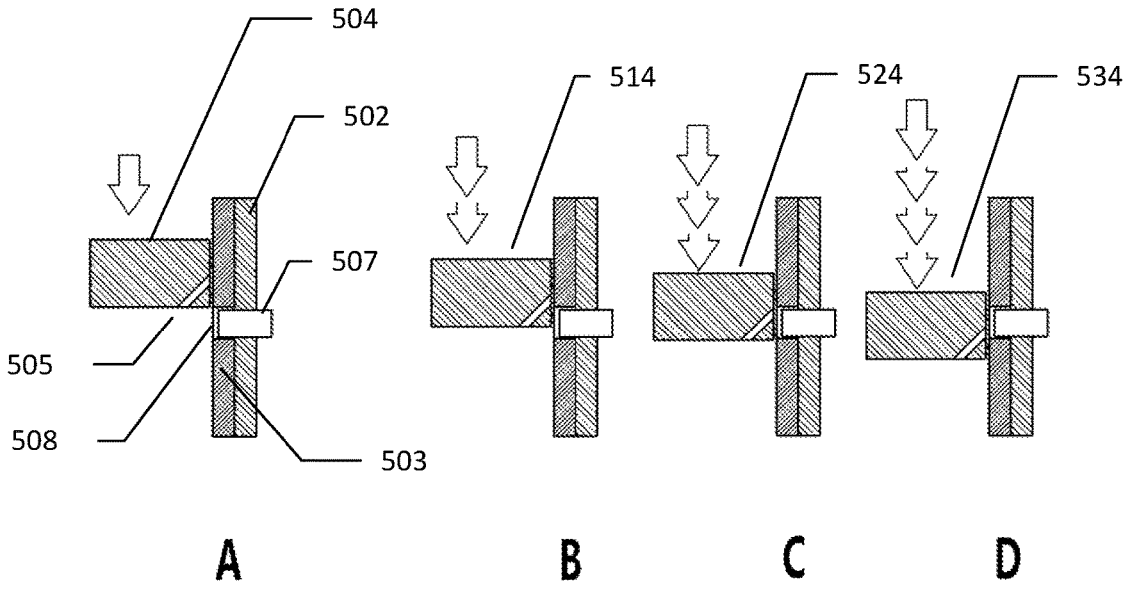
FIG. 5 is an illustration of the relative positions of the auxiliary piston and the ignition assembly cut-out passage in one of the embodiments of the present invention.

FIG. 5 shows the vertical positions and relations between ignition assembly and the aux. piston with a by-pass passage 505. State A of FIG. 5 is a partial front section view of FIG. 1. Wherein 504 is the aux. piston, 502 is the cylinder wall or engine block, 503 is the cylinder liner, 507 is the ignition assembly and its cut-out passage is 508, 505 is the by-pass passage on the aux. piston. 507 is mounted and sealed on the cylinder wall 502, the tip of the ignition assembly is connected to combustion chamber of the engine via the cut-out passage 508 on the cylinder liner. Where the cylinder liner and the cylinder wall are at fixed positions and the aux. piston is moving up and down in the cylinder liner. The by-pass passage 505 can be a simple straight through hole with one end at the vertical side of the aux. piston and the other end at the low face of the aux. piston. The by-pass passage 505 can be complex through holes with one end at the vertical side of the aux. piston and the other end(s) at the low face of the aux. piston.

At the position of state A of FIG. 5, (the tip of) the ignition assembly is fully connected to the combustion chamber via 508, and the right end of the by-pass passage 505 is sealed by the cylinder liner 503 by closely touching between the aux. piston 504 and cylinder liner 503. At this situation, the combustion chamber is securely sealed from outside environment.

When the aux. piston 504 is moving downward from the position of state A to state B of FIG. 5, as shown as 514, the tip of ignition assembly is partially connected to the combustion chamber because the cut-out passage is partially closed by the aux. piston 514, and the right end of the by-pass passage remains sealed by the cylinder liner by closely touching between the aux. piston and the cylinder liner. At this situation, the combustion chamber is also securely sealed from outside environment.

When the aux. piston 514 is moving downward from the position of state B to state C of FIG. 5, as shown as 524, the tip of ignition assembly is about to be cut off to the combustion chamber because the cut-out passage begins to be closed by the aux. piston, and the right end of the by-pass passage is connected to the cut-out passage, then the by-pass passage keeps the connection between the ignition assembly and the combustion chamber. At this situation, the combustion chamber is securely sealed from outside environment.

When the aux. piston 524 is moving downward from the position of state C to state D of FIG. 5, as shown as 534, the cut-out passage is fully closed by the aux. piston, and the tip of the ignition assembly remains connected to the combustion chamber via the by-pass passage, and the by-pass passage keeps the connection between the ignition assembly and the combustion chamber. At this situation, the combustion chamber is securely sealed from outside environment.

When the aux. piston 534 is further moving downward from the position of state D of FIG. 5, both the cut-out passage and the right end of the by-pass passage are closed by the aux. piston, and then the combustion chamber is fully sealed with ignition assembly. At this situation, the combustion chamber is securely sealed from outside environment.

Figure 6:
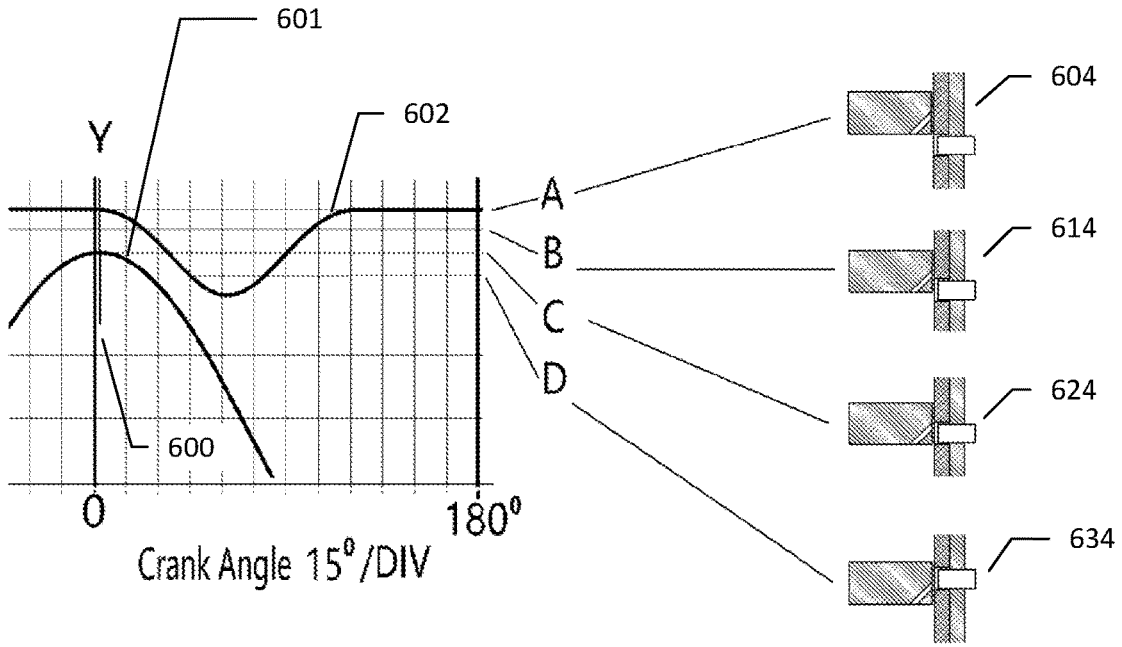
FIG. 6 is another illustration of the relative positions of the auxiliary piston and the ignition assembly cut-out passage in one of the embodiments of the present invention.

FIG. 6 is another illustration which shows the vertical positions and relations between ignition assembly and the aux. piston. Wherein 601 is the main piston position, 602 is the aux. piston position; state 604, 614, 624 and 634 are the different positions/states of the aux. piston. Wherein state A, B, C and D of FIG. 6 are corresponding to state A, B, C and D of FIG. 5 respectively. At the position of state A of FIG. 6, the ignition assembly is fully connected to the combustion chamber, and by-pass passage is closed by closely touching between the aux. piston and cylinder liner, shown as state 604 of FIG. 6.

When the aux. piston is further moving downward from the position of state A to state B of FIG. 6, the cut-out passage is partially closed but still connected to the combustion chamber, and the right end of the by-pass passage is closed by the aux. piston, shown as 614 of FIG. 6. The ignition assembly keeps connected with the combustion chamber. At this situation, the combustion chamber is securely sealed from outside environment.

When the aux. piston 614 is further moving downward from the position of state B to state C of FIG. 6, the cut-out passage is about to be fully closed by the aux. piston, and the by-pass passage is begin to connect the cut-out passage to the combustion chamber, as shown as 624 of FIG. 6. The ignition assembly keeps connected with the combustion chamber. At this situation, the combustion chamber is securely sealed from outside environment.

When the aux. piston 624 is further moving downward from the position of state C to state D of FIG. 6, the cut-out passage is fully closed by the aux. piston, and the by-pass passage keeps connecting between the cut-out passage and the combustion chamber, as shown as 634 of FIG. 6. The ignition assembly remains connected with the combustion chamber. At this situation, the combustion chamber is securely sealed from outside environment.

When the aux. piston is further moving downward from the position of state D of FIG. 6, both cut-out passage and the right end of the by-pass passage is fully closed and the combustion chamber is fully cut-off from ignition assembly. At this situation, the combustion chamber is securely sealed from outside environment.

From FIG. 6, it can be seen that in the combustion stroke, the uppermost position or the highest side of cut-out passage is at or below the uppermost position of the aux. piston lower face; the lowermost position or the lowest side of the cut-out passage is at or above the uppermost position of the main piston upper face. The cut-out passage is overlapped in vertical space with the position of the aux. piston. Wherein the lower face of the aux. piston is the equivalent lowest surface plane where the aux. piston outer surface is in closely and sealingly touching with the inside surface of the cylinder liner. The upper face of the main piston is the equivalent uppermost surface plane where the main piston outer surface is in closely and sealingly touching with the inside surface of the cylinder liner.

Again in FIG. 6, 600 is the top dead (TDC) center of the main piston. TDC 600 is located at 0° CA when the crankpin is without any offset, and TDC 600 is located at >0° CA when crankpin is with an offset.

Figure 7A:
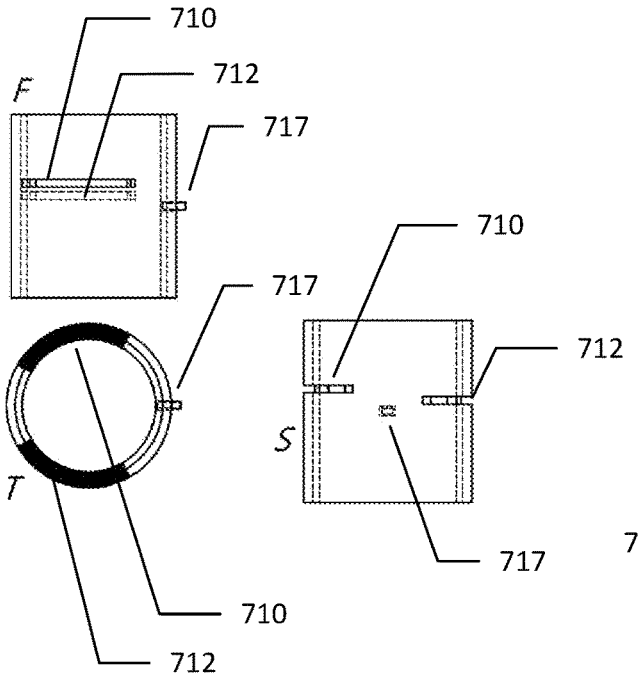
FIG. 7A is an illustration of the relative positions of the intake/exhaust ports and the ignition assembly and cut-out passage in one of the embodiments of the present invention.

FIG. 7A is an illusion of the positions of the ignition assembly and the intake/exhaust port in one of the embodiment of the engine, where F, T and S are the front, top and side partial-transparent views of the engine respectively. Wherein 710 is the intake port, 712 is the exhaust port, 717 is the ignition assembly. It can be seen that the position of the ignition assembly is not aligned with the position of intake or exhaust port both in radial and vertical position. Wherein the cut-out passage is at the tip of the ignition assembly and not shown here.

Figure 7B:
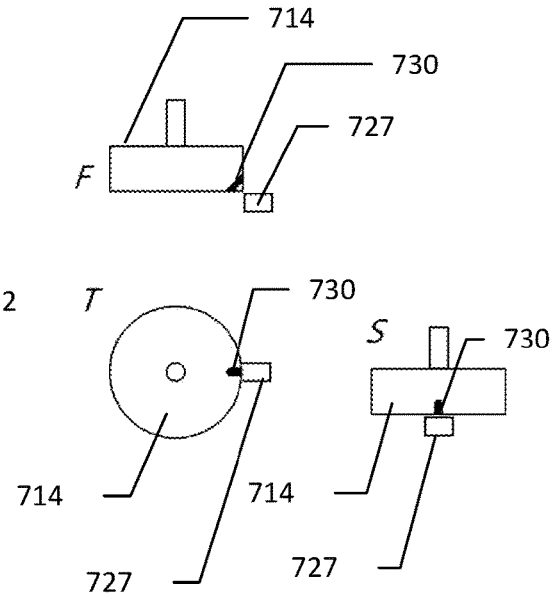
FIG. 7B is an illustration of the relative positions of the by-pass passage on the auxiliary piston and the ignition assembly and cut-out passage in one of the embodiments of the present invention.

FIG. 7B is an illusion of the positions of the ignition assembly and the aux. piston in one of the embodiment of the engine, where F, T and S are the front, top and side partial-transparent views of the engine respectively. Wherein 714 is the aux. piston, 730 is the by-pass passage on the aux. piston, 727 is the ignition assembly. It can be seen that only at certain positions of the aux. piston the ignition assembly is connected to the combustion chamber via the by-pass passage 730. Or in other words, the ignition assembly is connected to the combustion chamber when the cut-out passage on the cylinder liner is aligned with the right end of by-pass passage on the aux. piston. Wherein the cut-out passage is at the tip of the ignition assembly and not shown here. The by-pass passage can be a simple through hole with one end at the side of the aux. piston and the other end at the lower face of the aux. piston.

Figure 8:
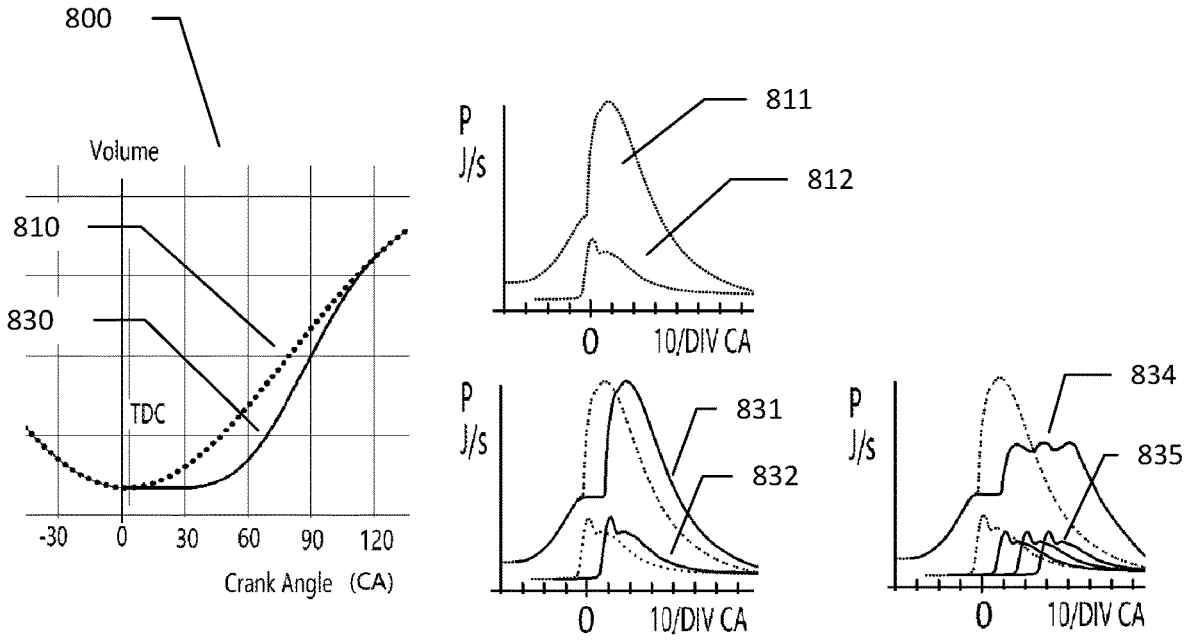
FIG. 8 is a comparison of heat release and cylinder pressure between a conventional piston engine and one of the embodiments of the present invention.

By combining different movements of the main piston and the aux. piston, different combustion chamber volume vs crank angle trajectories (profiles) can be obtained, as shown in 800 of FIG. 8. Wherein 810 is a combustion chamber volume vs crank angle trajectory in a conventional piston engine, the minimum combustion chamber volume is located at one point; 830 is the combustion chamber volume vs crank angle trajectory in one of the embodiments of the present invention engine with a main piston and an aux. piston. It can be seen that the minimum combustion chamber volume (or clearance combustion chamber volume Vc) is greatly extended in 830, or in other words, the combustion chamber volume keeps nearly constant from TDC to >30° CA, so that at any position from TDC to 30° CA, because the combustion chamber volume keeps unchanged, the cylinder pressure keeps unchanged at the same fuel combusted. This characteristic gives a great flexibility in fuel injection and combustion control. For example, 1), using delayed injection and/or combustion to increase torque on main crankshaft, using multiple injections and multiple combustions instead of single injection and single combustion to reduce cylinder pressure stress without compromising fuel efficiency, 2), using water or water-fuel mixture to reduce peak temperature stress in cylinder without compromising fuel efficiency. In 800 of FIG. 8, TDC can be at 0° CA or >0° CA at different crankpin offset. Wherein "nearly constant" means the variation of the combustion chamber volume from 0° CA to 30° CA is very small, for example, within 1%, 5% or 10%.

Refer to FIG. 8 again, where dotted lines or dashed lines are of conventional engine, and solid lines are of the engine of the present invention. A), curve 812 is a heat release curve in the combustion of a conventional piston engine, curve 811 is its corresponding cylinder pressure. B), the heat release and the cylinder pressure can be shifted to right side to a greater crank angle by delayed injection and delayed combustion, curve 832 and cure 831 is the delayed heat release and the delayed cylinder pressure in one of the embodiment of the invention by delayed combustion, it can be seen that the solid lines are shifted to the right side of the dotted or dashed lines. C), curve 835 and cure 834 is the heat release and the cylinder pressure in one of the embodiments of the invention by multiple injections and combustions with reduced fuel amount in reach injection, the single heat release (dotted or dashed line) is replaced by multiple reduced releases (solid lines), it can be seen that the peak cylinder pressure can be reduced but the pressure duration in time is extended. Benefited from the constant combustion chamber volume, the multiple combustions is much more flexible than in a conventional engine. Wherein "nearly constant" means the variation of the combustion chamber volume from 0° CA to 30° CA is very small, for example, within 1%, 5% or 10%.

Figure 9:
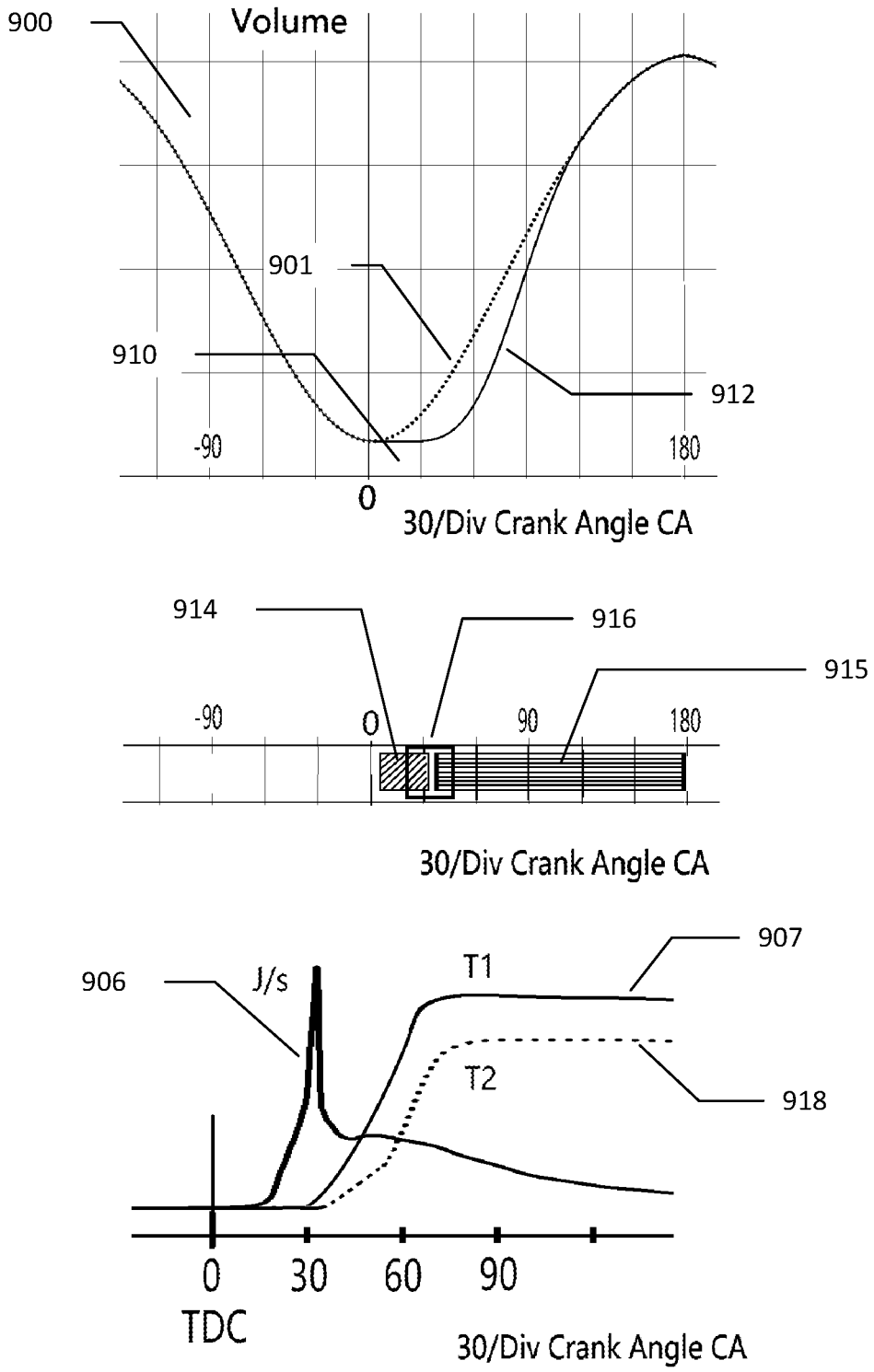
FIG. 9 is a comparison of heat release and combustion chamber temperature between a conventional engine and the novel engine when water is mixed with the fuel in one of the embodiments of the present invention.

By combining different movements of the main piston and the aux. piston, different combustion chamber volume vs crank angle trajectories (profiles) can be obtained, as shown in 900 of FIG. 9, wherein 901 is a combustion chamber volume vs crank angle in a conventional piston engine, 912 is a combustion chamber volume vs crank angle in one of the embodiments of the present invention engine with a main piston and an aux. piston, it can be seen that the minimum combustion chamber volume (or clearance combustion chamber volume Vc) is extended, or in other words, the combustion chamber volume keeps nearly constant from TDC to >30° CA, so that at any crank angle position from TDC to 30° CA (or within the constant volume) the cylinder temperature can be reduced by injection of water or by injection of fuel-water mixture; wherein area 914 is the crank angle positions for water injection or fuel-water injections, and area 915 is the positions the water is vaporized, area 914 and 915 can be overlapped in area 916 in real applications. Wherein "nearly constant" means the variation of the combustion chamber volume from 0° CA to 30° CA is very small, for example, within 1%, 5% or 10%.

Curve 906 is an example of heat release of a given combustion; curve 907 is the cylinder temperature without water injection, and curve 918 is the cylinder temperature with water injection when heat release keeps the same. The cylinder temperature is reduced from 907 to 918 because injected water takes great amount of heat energy in vaporization. And the cylinder pressure is not necessarily be reduced because the water expandes in volume when water is vaporized.

The said combustion chamber pressure and the cylinder pressure are the same thing in the above description. The said combustion chamber temperature and the cylinder temperature are the same thing in the above description.

The invention claimed is:

1. A piston engine and ignition assembly, comprising:

a cylinder liner and a cylinder wall, the cylinder liner encloses a chamber therein;

a main piston configured to fit sealingly inside the cylinder liner and move up and down along the centerline of the cylinder liner;

an auxiliary piston is configured to fit sealingly inside the cylinder liner and move up and down along the centerline of the cylinder liner;

wherein the main piston and the auxiliary piston move at different frequencies; the main piston and the auxiliary piston move at different stroke distances; the lowermost position of the auxiliary piston lower face is below the uppermost position of the main piston upper face;

the space between the auxiliary piston and the main piston within the cylinder liner defines a combustion chamber;

the said frequencies and the stroke distances of the auxiliary piston and the main piston are coordinated to keep the combustion chamber volume nearly constant from crank angle 0° CA to 30° CA;

an ignition assembly is mounted sealingly on the cylinder wall, the ignition assembly connects to the combustion chamber via a cut-out passage on the cylinder liner;

wherein the uppermost position of the cut-out passage is at or aligned with the uppermost position of the auxiliary piston lower face in combustion stroke, the lowermost position of the cut-out passage is at or aligned with the uppermost position of the main piston upper face;

wherein the auxiliary piston has a by-pass passage, the by-pass passage connects the ignition assembly to the combustion chamber when the auxiliary piston moves down below the uppermost position of the main piston and blocks the cut-out passage.

2. The piston engine and ignition assembly in claim 1, wherein:

the ignition assembly further comprises an ignition device and a pressure sensor passage.

3. The piston engine and ignition assembly in claim 1, wherein:

the ignition assembly further comprises an ignition device and a fuel injection nozzle.

4. The piston engine and ignition assembly in claim 1, wherein:

the ignition assembly further comprises an ignition device, a fuel injection nozzle and a pressure sensor passage which connects the combustion chamber to a pressure sensor in combustion stroke.

5. The piston engine and ignition assembly in claim 1, wherein:

the position of the by-pass passage on the auxiliary piston and the position of the cut-out passage on the cylinder liner are configured to connect the ignition assembly to the combustion chamber from crank angle 0° CA to 46° CA of the main piston.

6. The piston engine and ignition assembly in claim 1, wherein:

the said frequencies and the stroke distances of the auxiliary piston and the main piston are coordinated to keep the combustion chamber volume nearly constant from crank angle 0° CA to 30° CA of the main piston.

7. The piston engine and ignition assembly in claim 2, wherein:

the pressure sensor passage connects the combustion chamber to a pressure sensor to detect the combustion chamber pressure or cylinder pressure in combustion stroke in order to adjust the delay timing of ignition of the fuel to keep the peak pressure of the combustion chamber in combustion stroke being located at >30° CA to make higher fuel efficiency.

8. A piston engine with multiple fuel injections, comprising:

a cylinder liner and a cylinder wall; the cylinder liner encloses a chamber therein;

a main piston configured to fit sealingly inside the cylinder liner and move up and down along the centerline of the cylinder liner;

an auxiliary piston is configured to fit sealingly inside the cylinder liner and move up and down along the centerline of the cylinder liner;

wherein the main piston and the auxiliary piston move at different frequencies, the main piston and the auxiliary piston move at different stroke distances, the lowermost position of the auxiliary piston lower face is below the uppermost position of the main piston upper face;

the space between the auxiliary piston and the main piston within the cylinder liner defines a combustion chamber; the said frequencies and the stroke distances of the auxiliary piston and the main piston are coordinated to keep the combustion chamber volume nearly constant from crank angle 0° CA to 30° CA;

an ignition assembly is mounted sealingly on the cylinder wall, the ignition assembly connects to the combustion chamber via a cut-out passage on the cylinder liner;

wherein the uppermost position of the cut-out passage is at or aligned with the uppermost position of the auxiliary piston lower face in combustion stroke, the lowermost position of the cut-out passage is at or aligned with the uppermost position of the main piston upper face, wherein the auxiliary piston has a by-pass passage, the by-pass passage connects the ignition assembly to the combustion chamber when the auxiliary piston moves down below the uppermost position of the main piston and blocks the cut-out passage;

fuel is injected multiple times in each cycle from crank angle −30° CA to 30° CA.

9. The piston engine with multiple fuel injections in claim 8, wherein:

the ignition assembly further comprises an ignition device and a pressure sensor passage.

10. The piston engine with multiple fuel injections in claim 8, wherein:

the ignition assembly further comprises an ignition device and a fuel injection nozzle.

11. The piston engine with multiple fuel injections in claim 8, wherein:

the ignition assembly further comprises an ignition device, a fuel injection nozzle and a pressure sensor passage which connects a pressure sensor to the combustion chamber in combustion stroke.

12. The piston engine with multiple fuel injections in claim 8, wherein:

the position of by-pass passage on the auxiliary piston and the position of the cut-out passage on the cylinder liner are configured to connect the ignition assembly to the combustion chamber from crank angle 0° CA to 46° CA of the main piston.

13. The piston engine with multiple fuel injections in claim 9, wherein:

the pressure sensor passage connects the combustion chamber to a pressure sensor to detect the combustion chamber pressure or cylinder pressure of each combustion in combustion stroke in order to adjust the fuel injection timing and the fuel ignition timing to keep each peak pressure of the combustion chamber in combustion stroke being located and scattered from crank angle 20° CA to >30° CA to reduce cylinder pressure stress.

14. A piston engine with fuel-water mixture, comprising:

a cylinder liner and a cylinder wall, the cylinder liner encloses a chamber therein;

a main piston configured to fit sealingly inside the cylinder liner and move up and down along the centerline of the cylinder liner therewithin;

an auxiliary piston is configured to fit sealingly inside the cylinder liner and move up and down along the centerline of the cylinder liner;

the lowermost position of the auxiliary piston lower face is below the uppermost position of the main piston upper face, the space between the auxiliary piston and the main piston within the cylinder liner defines a combustion chamber;

wherein the main piston and the auxiliary piston move at different frequencies, the main piston and the auxiliary piston move at different stroke distances; the said frequencies and the stroke distances of the auxiliary piston and the main piston are coordinated to keep the combustion chamber volume nearly constant from crank angle 0° CA to 30° CA;

an ignition assembly is mounted sealingly on the cylinder wall, the ignition assembly connects to the combustion chamber via a cut-out passage on the cylinder liner, wherein the uppermost position of the cut-out passage is at or aligned with the uppermost position of the auxiliary piston lower face in combustion stroke, the lowermost position of the cut-out passage is at or aligned with the uppermost position of the main piston upper face;

wherein the auxiliary piston has a by-pass passage, the by-pass passage connects the ignition assembly to the combustion chamber when the auxiliary piston moves down below the uppermost position of the main piston and blocks the cut-out passage;

water or fuel-water mixture is injected from crank angle 0° CA to 30° CA to reduce temperature stress of the cylinder.

15. The piston engine with fuel-water mixture in claim 14, wherein:

the ignition assembly further comprises an ignition device and a pressure sensor passage.

16. The piston engine with fuel-water mixture in claim 14, wherein:

the ignition assembly further comprises an ignition device and a fuel injection nozzle.

17. The piston engine with fuel-water mixture in claim 14, wherein:

the ignition assembly further comprises an ignition device, a fuel injection nozzle and a pressure sensor passage which connects a pressure sensor to the combustion chamber in combustion stroke.

18. The piston engine with fuel-water mixture in claim 14, wherein:

the position of the by-pass passage on the auxiliary piston and the position of the cut-out passage on the cylinder liner are configured to connect the ignition assembly to the combustion chamber from crank angle 0° CA to 46° CA of the main piston.

19. The piston engine with fuel-water mixture in claim 15, wherein:

the pressure sensor passage connects the combustion chamber to a pressure sensor to detect the combustion chamber pressure or cylinder pressure in combustion stroke in order to adjust the delay timing of ignition of the water or fuel-water mixture to keep the peak pressure of the combustion chamber in combustion stroke being located at >30° CA to improve fuel efficiency and reduce cylinder temperature stress.

* * * * *